US007901516B2

(12) United States Patent
Gonzalez

(10) Patent No.: US 7,901,516 B2
(45) Date of Patent: Mar. 8, 2011

(54) CLEANING COMPOSITIONS FOR REMOVING ORGANIC DEPOSITS ON SURFACES AND METHOD OF USE

(76) Inventor: Marco T. Gonzalez, Pembroke Pines, FL (US)

( * ) Notice: Subject to any disclaimer, the term of this patent is extended or adjusted under 35 U.S.C. 154(b) by 0 days.

(21) Appl. No.: 12/264,938

(22) Filed: Nov. 5, 2008

(65) Prior Publication Data

US 2009/0114251 A1 May 7, 2009

Related U.S. Application Data

(60) Provisional application No. 60/985,302, filed on Nov. 5, 2007.

(51) Int. Cl.

| | |
|---|---|
| ***B08B 3/10*** | (2006.01) |
| ***C11D 7/26*** | (2006.01) |
| ***C11D 7/50*** | (2006.01) |

(52) U.S. Cl. ..... 134/34; 134/26; 510/109; 510/505

(58) Field of Classification Search ..... 134/22.1, 134/22.11, 22.12, 40, 42; 510/109
See application file for complete search history.

(56) References Cited

U.S. PATENT DOCUMENTS

| | | | | |
|---|---|---|---|---|
| 4,124,522 | A * | 11/1978 | Barton | 134/42 |
| 5,922,665 | A * | 7/1999 | Liu | 510/365 |
| 6,284,056 | B1 * | 9/2001 | Gonzalez | 134/40 |
| 2006/0118819 | A1 * | 6/2006 | Hanson et al. | 257/189 |

* cited by examiner

*Primary Examiner* — Michael Kornakov
*Assistant Examiner* — Natasha Campbell
(74) *Attorney, Agent, or Firm* — David W. Barman

(57) ABSTRACT

The present invention is improved cleaning composition having at least one ketone, water, and a nonionic surfactant and a method of using the composition for cleaning organic residue.

2 Claims, No Drawings

CLEANING COMPOSITIONS FOR REMOVING ORGANIC DEPOSITS ON SURFACES AND METHOD OF USE

INDEX TO RELATED APPLICATIONS

This application claims the benefit of U.S. Provisional Patent Application No. 60/985,302 filed Nov. 5, 2007, the disclosure of which is incorporated herein by reference in its entirety.

BACKGROUND OF THE INVENTION

Prior inventions in their most basic forms consist of an alcohol, water, salt in crystalline form, and a surfactant. The previous inventions are used to remove organic deposits from hard to reach surfaces, specifically a smokers devices. The previous inventions require the consumer to shake the item being cleaned vigorously, for approximately one minute while submerged in the cleaning composition. Salt, in crystalline form, acts as an abrasive material working side-by-side with the liquid portion of the cleaning composition to remove organic deposit in the hard to reach places. The first problem with the previous inventions is the amount of time required to remove the organic deposits can be quite tiresome. The second problem with the previous inventions is they do not completely remove all organic residues on internal hard to reach surfaces, as well as external reachable surfaces. Finally, the previous inventions contain an excessive amount of abrasive material, which limits the amount liquid cleaning solution of the composition available to the consumer. By adding a ketone, in the form of acetone, to the previous inventions the cleaning time is reduced by 100%, all organic residue's are removed, and the abrasive materials are reduced by half, if not eliminated.

BRIEF SUMMARY OF THE INVENTION

The current invention provides an improved cleaning composition, which cleans and sterilizes more effectively and efficiently in a period of 1-30 seconds. This was accomplished by a formulation based on acetone, a ketone. Additionally, according to the Environmental Protection Agency acetone is no longer referred to as volatile organic compound, and has been labeled as relatively non-toxic and readily biodegradable in water.

Acetone based cleaning products result in all residues being removed on both internal and external surfaces. Additionally, acetone based cleaning products allow the liquid portion of the composition to work more effectively allowing the abrasive material to act as more of an aide to the liquid portion rather than working side-by-side the liquid portion of the composition. Acetone based cleaning products allow for reduction of the abrasive material by at least half, and/or eliminate abrasive material all together.

DETAILED DESCRIPTION OF THE PREFERRED EMBODIMENTS

The present invention in its most basic form includes:

1) a ketone in the form of acetone
2) an inorganic salt
3) water wherein from approximately 1% to approximately 80% of the total composition is acetone, and approximately 0.0001% to approximately 29% of the total composition is an inorganic salt.

The following is a list of acceptable salts for the first preferred embodiment:

| | | | | | |
|---|---|---|---|---|---|
| Sodium Chloride | NaCl | mwt. | 58.4428 | sp. gr. | 2.165 |
| Sodium Bromide | NaBr | mwt. | 102.90 | sp. gr. | 3.203 |
| Magnesium Bromide | MgBr | mwt. | 184.13 | sp. gr. | 3.72 |
| Magnesium Chloride | MgCl | mwt. | 95.22 | sp. gr. | 2.316 |
| Potassium Chloride | KCL | mwt. | 74.54 | sp. gr. | 1.984 |
| Potassium Bromide | KBr | mwt. | 119.01 | sp. gr. | 2.75 |
| Zinc Chloride | ZnCl | mwt. | 136.30 | sp. gr. | 2.91 |

A preferred salt is Sodium Chloride.

A preferred embodiment of the present invention includes:

1) a ketone in the form of acetone
2) an inorganic salt
3) water
4) a surfactant wherein from approximately 1% to approximately 80% of the total composition is acetone, and approximately 0.0001% to approximately 29% of the total composition is an inorganic salt, and approximately 0.05% to 10% of the total composition consists of octoxynol, a surfactant.

A second embodiment of the present invention includes:

1) a ketone in the form of acetone
2) an inorganic salt
3) water
4) a terpene
5) and a surfactant wherein from approximately 1% to approximately 80% of the total composition is acetone, approximately 0.0001% to approximately 29% of the total composition is an inorganic salt, approximately 2% to approximately 15% of the total composition consists of d-limonene, a terpene, and approximately 0.05% to approximately 10% of the total composition consists of octoxynol, a surfactant.

The third preferred embodiment of the present invention includes:

1) a ketone in the form of acetone
2) water
3) a terpene
4) a surfactant wherein from approximately 1% to approximately 80% of the total composition is acetone, approximately 2% to approximately 15% of the total composition includes of d-limonene, a terpene, and approximately 0.05% to approximately 10% of the total composition includes octoxynol, a surfactant.

Example #1

This example contains following components:

| Component | wt. % |
|---|---|
| Acetone | 55 |
| Sodium Chloride (crystal) | 24 |
| Deionized water | 16 |
| Octoxynol-9 | 2 |
| Fragrance | 1.5 |
| Dye | 1.5 |
| Total | 100% |

This was prepared by first water with octoxynol, fragrance, and dye. Then, acetone was added and it was mixed completely. Next, the sodium chloride crystals were added to the mixture slowly to allow small portions to dissolve. Finally, the composition was shaken thoroughly. Once settled, the composition remained stable.

The composition was then shaken again and poured into a substrate containing a large amount of organic deposits. It was then shaken vigorously for approximately 30 seconds. Results were noticeable immediately. All organic deposits from the interior were successfully removed without damage to the substrate.

The composition was again tested on a much smaller substrate. Due to size, the substrate was placed into a resealable plastic bag. This substrate also contained organic deposits on the exterior, as well as the interior. The substrate was then shaken for 30 seconds. Results were noticeable immediately. All organic deposits from the interior, as well as the exterior, were successfully removed without damage to the substrate.

Example #2

This example contains following components:

| Component | % wt. |
|---|---|
| Acetone | 59 |
| Sodium Chloride (crystal) | 20 |
| Deionized Water | 6.5 |
| D-limonene | 8 |
| Octoxynol-9 | 3 |
| Fragrance | 1.5 |
| Dye | 2.0 |
| Total | 100% |

This was prepared by first combining water with the octoxynol, d-limonene, fragrance, and dye. Then, acetone was added and the solution was mixed completely. Next, finely divided sodium chloride crystals were added to the mixture slowly, which allowed small portions to dissolve. Finally, the composition was shaken thoroughly. Once settled, the composition remained stable.

The composition was then shaken again and poured into a substrate containing a large amount of organic deposits. It was then shaken vigorously for approximately 30 seconds. Results were noticeable immediately. All organic deposits from the interior were successfully removed without damage to the substrate.

The composition was again tested on a much smaller substrate. Due to size, the substrate was placed into a resealable plastic bag. This substrate also contained organic deposits on the exterior, as well as the interior. The substrate was then shaken for 30 seconds. Results were noticeable immediately. All organic deposits from the interior, as well as the exterior, were successfully removed without damage to the substrate.

Example #3

| Component | % wt. |
|---|---|
| Acetone | 74 |
| Deionized water | 9 |
| D-limonene | 10 |
| Octoxynol-9 | 4 |

-continued

| Component | % wt. |
|---|---|
| Fragrance | 1.5 |
| Dye | 1.5 |
| Total | 100% |

This was prepared by first combining water with the octoxynol, d-limonene, fragrance, and dye. Then, acetone was added and the solution was mixed completely. Once settled, the composition remained stable.

The composition was then shaken again and poured into a substrate containing a large amount of organic deposits. It was then shaken vigorously for approximately 30 seconds. Results were noticeable immediately. All organic deposits from the interior were successfully removed without damage to the substrate.

The composition was again tested on a much smaller substrate. Due to size, the substrate was placed into a resealable plastic bag. This substrate also contained organic deposits on the exterior, as well as the interior. The substrate was then shaken for 30 seconds. Results were noticeable immediately. All organic deposits from the interior, as well as the exterior, were successfully removed without damage to the substrate.

As one can see from the examples above, all organic deposits were successfully removed from all test substrates. Therefore, by adding acetone to the previous inventions the main objectives to reduce cleaning time by 100%, remove all organic residues, and to reduce abrasive materials by half, if not eliminate, were completed.

And an additional formulation includes:

a) Acetone
b) Water
c) An inorganic salt, preferably NaCl
d) A nonionic surfactant, preferably octoxynol-5, octoxynol-8, and/or octoxynol-13

A second additional formulation includes:

a) Acetone
b) Water
c) An inorganic salt, preferably NaCl
d) A nonionic surfactant, preferably octoxynol-5, octoxynol-8, and/or octoxynol-13
e) A terpene, preferably D-Limonene A third additional formulation (without NaCl) includes:

a) Acetone
b) Water
c) A nonionic surfactant, preferably octoxynol-5, octoxynol-8, and/or octoxynol-13

A fourth additional formulation (without NaCl) includes:

a) Acetone
b) Water
c) A nonionic surfactant, preferably octoxynol-5, octoxynol-8, and/or octoxynol-13
d) A terpene, preferably D-Limonene Ketone Example #1

| | |
|---|---|
| Acetone | 67% |
| Water | 13.3% |
| NaCl | 19.7% |

This was prepared by first combining acetone and water. Next, the sodium chloride crystals were added to the mixture slowly to allow small portions to dissolve. Finally, the composition was shaken thoroughly. Once settled, the composition remained stable.

Ketone Example #2

| | |
|---|---|
| Acetone | 65% |
| Water | 13.3% |
| NaCl | 19.7 |
| Octoxynol-13 | 2% |

This was prepared by first combining acetone, water, and octoxynol-13. Next, the sodium chloride crystals were added to the mixture slowly to allow small portions to dissolve. Finally, the composition was shaken thoroughly. Once settled, the composition remained stable.

Ketone Example #3

| | |
|---|---|
| Acetone | 65% |
| Water | 13.3% |
| NaCl | 19.7% |
| Octoxynol-5 | 2% |

This was prepared by first combining acetone, water, and octoxynol-5. Next, the sodium chloride crystals were added to the mixture slowly to allow small portions to dissolve. Finally, the composition was shaken thoroughly. Once settled, the composition remained stable.

Ketone Example #4

| | |
|---|---|
| Acetone | 65% |
| Water | 13.3% |
| NaCl | 19.7% |
| Octoxynol-8 | 2% |

This was prepared by first combining acetone, water, and octoxynol-8. Next, the sodium chloride crystals were added to the mixture slowly to allow small portions to dissolve. Finally, the composition was shaken thoroughly. Once settled, the composition remained stable.

Ketone Example #5

| | |
|---|---|
| Acetone | 59% |
| Water | 13.3% |
| NaCl | 19.7% |
| Octoxynol-5 | 2% |
| D-Limonene | 6% |

This was prepared by first combining acetone, water, octoxynol-8, and d-limonene. Next, the sodium chloride crystals were added to the mixture slowly to allow small portions to dissolve. Finally, the composition was shaken thoroughly. Once settled, the composition remained stable.

Ketone Example #6

| | |
|---|---|
| Acetone | 65% |
| Water | 13.3% |
| Octoxynol-8 | 5% |
| D-Limonene | 16.7 |

This was prepared by first combining acetone, water, octoxynol-8, and d-limonene. No NaCl was added to this composition. Then the composition was shaken thoroughly. Once settled, the composition remained stable.

Ketone Example #7

| | |
|---|---|
| Acetone | 62% |
| Water | 13.3% |
| NaCl | 19.7% |
| Nonionic Surfactant | 2% |
| Fragrance | 1.4% |
| Dye | 1.6% |

This was prepared by first combining acetone, water, and octoxynol-8. Next, the sodium chloride crystals were added to the mixture slowly to allow small portions to dissolve. Finally, the composition was shaken thoroughly. Once settled, the composition remained stable.

Method of Use

Substrates in which composition was tested on:

1. A smokers pipe, large and small
2. A stained wine glass, in which a full glass of wine was allowed to evaporate, and
3. A Round bottom flask w/burnt resins stuck to the interior.

In general, the method of cleaning a surface comprises the steps of:

a. providing a composition according to the present invention to a surface having organic residue to be removed;
b. agitating the composition for up to 30 seconds;
c. removing the agitated composition;
d. rinsing the surface with water.

The composition was then shaken again and poured into a large smoker's pipe containing a large amount of organic deposits. It was then shaken vigorously for approximately 10-30 seconds. Results were noticeable immediately. All organic deposits from the interior were successfully removed without damage to the substrate.

The composition was again tested on a much smaller smoker's pipe. Due to size, the substrate was placed into a resealable plastic bag. This substrate also contained organic deposits on the exterior, as well as the interior. The substrate was then shaken vigorously in the resealable plastic bag for approximately 10-30 seconds. Results were noticeable immediately. All organic deposits from the interior, as well as the exterior, were successfully removed without damage to the substrate.

The composition was then shaken again and poured into a stained wine glass, in which a full glass of wine was allowed to evaporate. It was then rotated vigorously, clockwise or counter-clockwise, for approximately 10-30 seconds. Results were noticeable immediately. All wine stains from the interior were successfully removed without damage to the substrate.

The composition was then shaken again and poured into a round bottom flask with burnt resins stuck to the interior. It was then shaken vigorously for approximately 10-30 seconds. Results were noticeable immediately. All organic deposits from the interior were successfully removed without damage to the substrate While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A method of cleaning a surface comprising the steps of:

a. providing a composition consisting of
at least one ketone in amount of 11 to 80 percent;
water in amount of 6.5 to 16 percent; and
0.05 to 10 percent octoxynol,
to a surface having organic residue to be removed;

b. agitating the composition for up to 30 seconds;

c. removing the agitated composition;

d. rinsing the surface with water.

2. A method of cleaning a smokers pipe comprising the steps of:

a. providing a composition consisting of a ketone in amount of 11 to 80 percent, water in amount of 6.5 to 16 percent, and a nonionic surfactant in an amount of 0.05 to 10 percent to a smokers pipe having organic residue to be removed;

b. agitating the composition for up to 30 seconds;

c. removing the agitated composition;

d. rinsing the surface with water.

* * * * *